United States Patent [19]

Johnson et al.

[11] Patent Number: 4,919,348

[45] Date of Patent: Apr. 24, 1990

[54] DUST SEAL FOR GYRATORY ROCK CRUSHERS

[76] Inventors: Louis W. Johnson; Bruce G. Johnson, both of 2435 Prairie Rd., Eugene, Oreg. 97402

[21] Appl. No.: 418,857

[22] Filed: Oct. 10, 1989

[51] Int. Cl.[5] ..... B02C 2/04

[52] U.S. Cl. ..... 241/215; 241/216

[58] Field of Search ..... 241/207–216, 241/286, 290

[56] References Cited

U.S. PATENT DOCUMENTS

| | | | |
|---|---|---|---|
| 2,224,542 | 12/1940 | Gruender et al. | 83/10 |
| 3,834,633 | 9/1974 | Dougall et al. | 241/207 X |
| 4,192,472 | 3/1980 | Johnson | 241/215 |

OTHER PUBLICATIONS

Nordberg promotion drawing.

*Primary Examiner*—Timothy V. Eley

[57] ABSTRACT

A first annular seal member on the base of a gyratory rock crusher is associated with a second annular seal member on the crusher cone. These two seal members have cooperating spherical surfaces which rub slidably together in the gyratory movements. An air sealing chamber is formed by the sealing members and other portions of the crusher and is associated with an annular groove in the first seal member having an inlet with a forced air system in an arrangement wherein air currents intercept dust moving along the spherical surfaces and also carry such dust away from inner portions of the crusher.

14 Claims, 5 Drawing Sheets

54
74'
48'
124
122
126
12
50
10
120
72'
30
40
18
32
34
36
38
62
64
52
11

DUST SEAL FOR GYRATORY ROCK CRUSHERS

BACKGROUND OF THE INVENTION

This invention relates to new and useful improvements in dust seals for gyratory rock crushers.

Effective dust seals for cone or gyratory-type rock crushers have been extremely difficult to achieve. The internal working parts (bearings, gears, shafts, oil pumps, and lubricating oil) must be protected from both rock dust developed during crushing and other contaminants, otherwise the best machines become too costly to maintain. No matter how good the crusher may be, if rock dust cannot be excluded, the machine is not viable.

Certain mechanisms using spinning labyrinth seals, such as in U.S. Pat. No. 3,118,623, are very effective for excluding dust, but such machines are restricted to smaller sizes because of the very high costs, speed limitations, and inadequate load carrying capacities of larger roller thrust bearings. In the larger sizes which are required to produce crushed rock in the capacities that today's and future markets demand, bigger crushers are essential.

Flexible seals have also been used, such as shown in U.S. Pat. Nos. 2,224,542, 2,832,547 and 4,192,472. Such seals comprise frusto-conical members secured between the crusher head and head support and can be designed for the larger type crusher. In view of the violent action of the crusher head, however, such flexible seals have been found to be short-lived. Rubbing seals have also been used and have a structure wherein one part of the seal is stationary on the base frame and the other part is attached to the gyrating cone head. Such a seal exposes a substantial surface area in a continuously moving orbit to the crusher's center line. Very fine rock dust will adhere to this surface. As this surface moves inward, most of the dust will be rubbed off but some will succeed in passing between the sealing surfaces. Over a period of time, dust accumulation reaches destructive levels. Efforts have also been made to use internal air pressure but such have not been satisfactory since it is difficult to push dust out and effective means have not been provided to prevent air from flowing into internal working parts such as into oil return drains.

SUMMARY OF THE INVENTION

A primary object of the present invention is to provide a dust seal for gyratory rock crushers utilizing spherical surface rubbing type seals in combination with dust intercepting air means and inner seals to prevent the dust from traveling across the seal and into internal working parts of the crusher.

Another object is to provide a dust seal of the type described wherein said dust intercepting air means includes an air chamber between the rubbing seals and internal seals in the crusher.

Another object of the invention is to provide a dust seal of the type described wherein air inlet means includes filters for supplying dust free air to the dust intercepting means.

Another object of the invention is to provide a dust seal of the type described which is relatively simple in construction and easy to replace and maintain.

In carrying out such objectives, a first annular seal is provided on the base frame and a second annular seal is provided on and driven with the crusher cone, these seals having cooperating spherical rubbing engagement in the gyratory movements of the cone. An annular groove is provided in the first seal, and an air chamber is formed interiorly by the two seals and by internal seals in the crusher. Filter means are provided in the air moving system for capturing the dust and other contaminants.

DETAILED DESCRIPTION OF A PREFERRED EMBODIMENT

Figure 1:
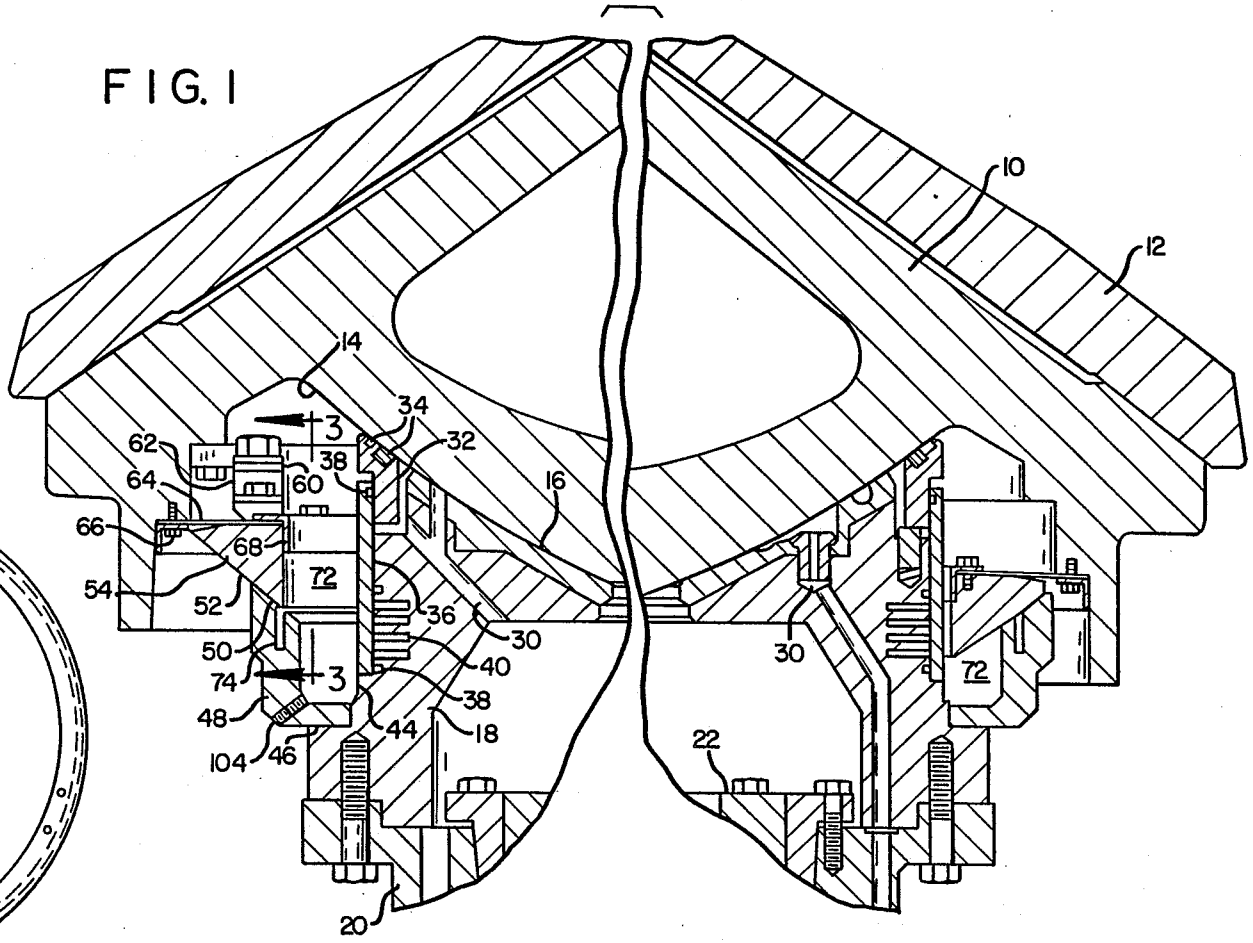
FIG. 1 is a foreshortened vertical central sectional view of a gyratory rock crusher and dust seal employing principles of a first embodiment of the present invention.
Figure 9:
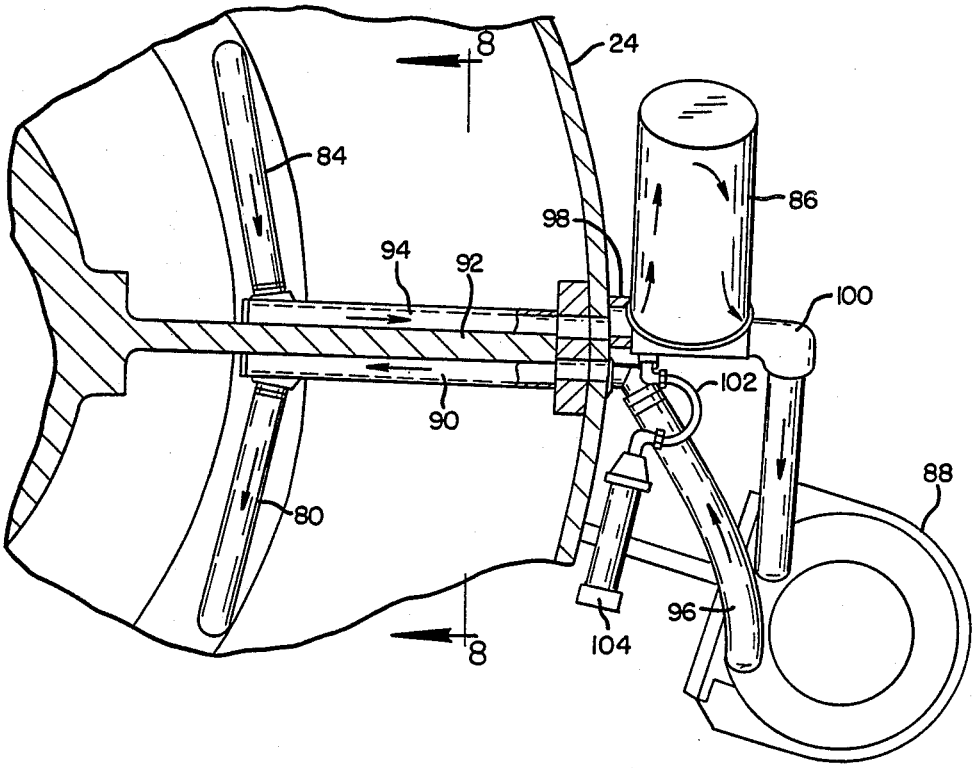
FIG. 9 is a sectional view taken on the line 9—9 of FIG. 8 and showing additional details of the air circulating system.

With particular reference to the drawings and first to the embodiment of FIG. 1, the numeral 10 represents a crusher cone or head driven in a gyrating motion by structure well understood in the art. This cone is associated with a mantle 12 and bowl, not shown, which function together to crush rock. The cone 10 has a lower convex spherical bearing surface 14 slidably supported on an upper spherical surface 16 of a cone support portion 18 secured to the base frame 20 of the crusher. Base frame 20 houses operating mechanism 22 for an upright shaft, not shown, connected to the crusher cone and operative to produce the gyrating movement on its support surface 16. Crusher frame 20 is associated with an outer defining wall 24, FIG. 9, and other support structure, not shown. The structure thus far described is known, namely, as shown in U.S. Pat. No. 4,192,472. Also, as is known, the spherical support surface 16 is provided with a suitable bearing surface, including lubricating means 30 for oil.

In accordance with the present invention, a sealing ring 32 with oil and dust seals 34 is provided at the outer periphery of the surface 16 of support 18. Also, cone support 18 is provided with a vertical sealing band or ring 36 which extends upwardly in overlapping surface engagement with the sealing ring 32. This band has end seals 38 engageable with the members 18 and 32 and it also forms an outer defining wall for water cooling ducts 40. Seals 34 and 38 serve first to confine water and oil within the head, second to form a secondary barrier for dust from entering internal working parts of the crusher, and third to form one side of an air chamber, to be described, which in combination with other structure forms a primary barrier against dust.

The cone support 18 has a stepped peripheral groove 44 forming an inset portion for the band 36 and also forming a shoulder 46 for supporting an annular base seal or ring 48. The seal 48 has a right angle configuration in cross section and is bolted or otherwise secured to the head support 18. The upper surface 50 of this seal is spherical and has rubbing engagement with a correspondingly shaped spherical surface 52 of an annular cone seal 54 having a triangular configuration in cross section and operative in gyrating movements with the cone 10. The centers of each spherical radii coincide with the vertex of the crusher's vertical center line and the center line of the eccentric.

Figure 3:
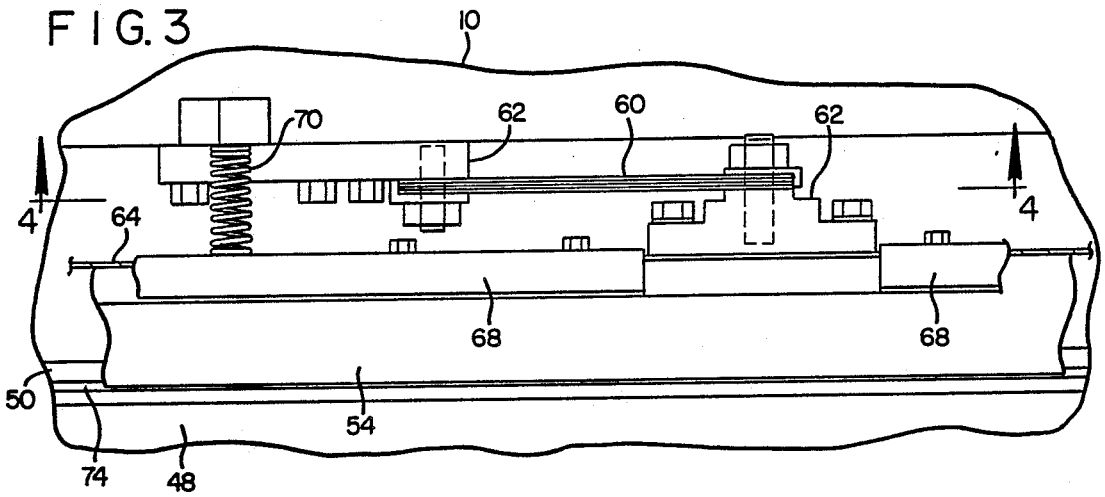
FIG. 3 is an enlarged fragmentary sectional view taken on the line 3—3 of FIG. 1 and showing connecting drive structure between the crusher cone and the seal driven thereby.
Figure 4:
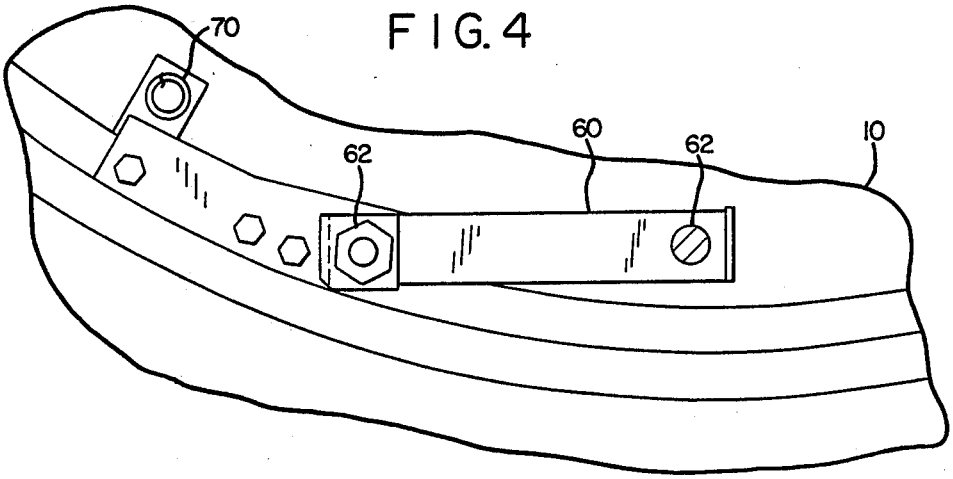
FIG. 4 is a sectional view taken on the line 4—4 of FIG. 3.
Figure 5:
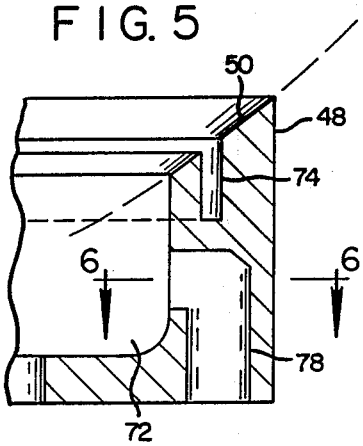
FIG. 5 is an enlarged fragmentary sectional view taken similar to FIG. 1 and showing in particular the structure of the base seal at the air circulating inlet.
Figure 6:
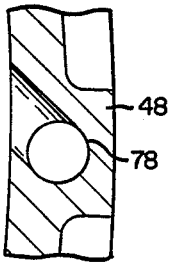
FIG. 6 is a fragmentary sectional view taken on the line 6—6 of FIG. 5.
Figure 7:
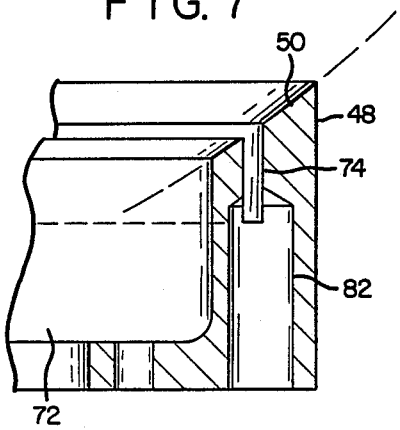
FIG. 7 is a cross sectional view taken similar to FIG. 5 but showing the air circulating outlet in the base seal.
Figure 8:
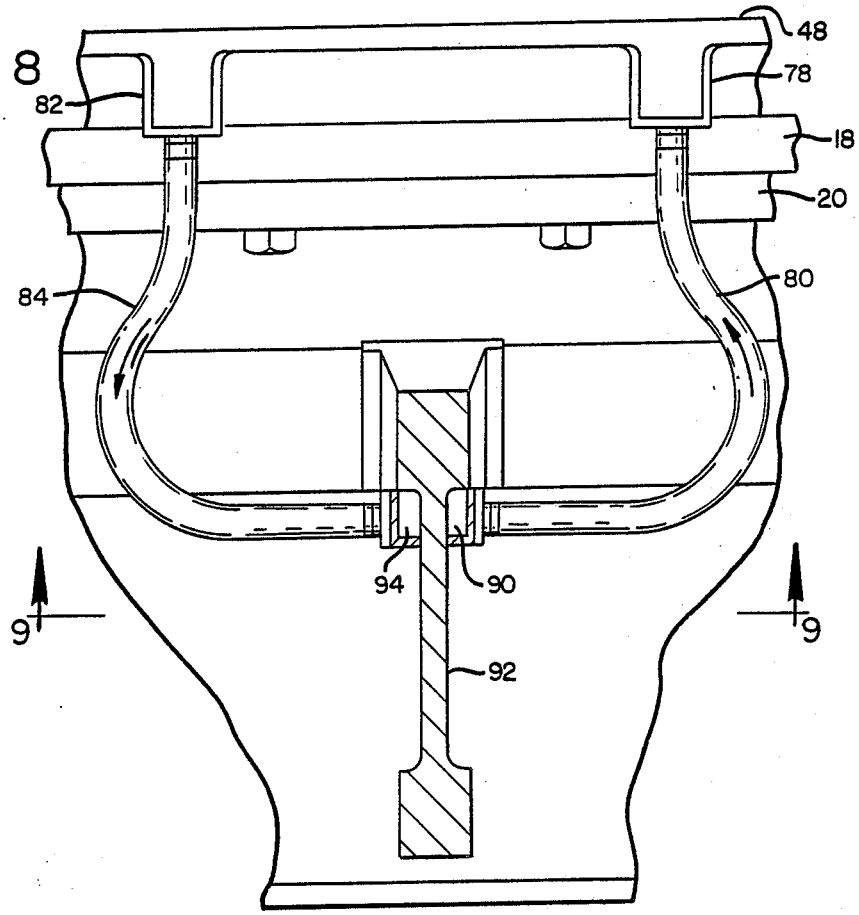
FIG. 8 is a fragmentary elevational view illustrating inlet and outlet supply means in the air circulating system, this view being taken on the line 8—8 of FIG. 9.

Securement of the seal 54 to the cone and providing positive movement therewith is accomplished by a plurality of heavy duty horizontal layered leaf spring assemblies 60, FIGS. 3 and 4, extending substantially tangentially of the seal 54 and having their ends secured by suitable connections 62 to this seal and the cone.

An annular flexible sealing strip 64 is secured along one of its longitudinal edges to the cone, as by fasteners 66, and along its other longitudinal edge to the upper surface of the cone seal 54, as by right angle clamp segments 68. Cone seal 54 is held in firm engagement against the angled surface 50 of the base 48 by a suitable number of compression springs 70 acting between the cone 10 and the clamp segments 68.

Figure 2:
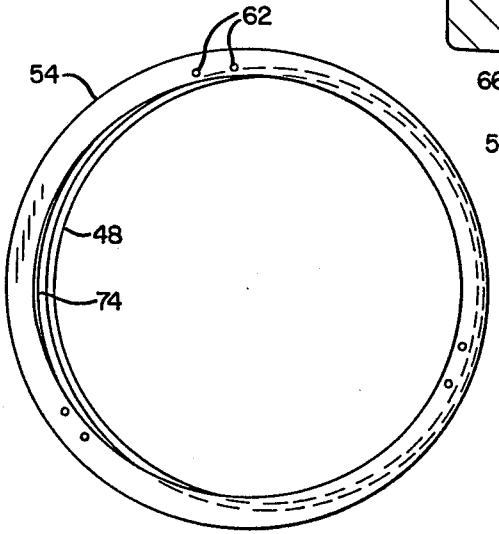
FIG. 2 is a top plan view of rubbing seals of FIG. 1 apart from other mechanism of the crusher.

With particular reference to FIG. 2, as the crusher is running, the base seal 48 is stationary and the cone seal 54 exposes a substantial surface area of the base seal 48 in a continuously moving orbit to the crusher's center line. Very fine rock dust will adhere to the bottom surface 52 of the cone seal, and as this surface moves inward most of the dust will be rubbed off. Some dust, however, will succeed in passing between the sealing surfaces. Over a period of time, the accumulation that passes through the seals would reach destructive levels but in accordance with the present invention, air chamber and air supply means are provided that catch and remove dust particles and other contaminants, as will now be described.

As one part of the dust and contaminant removal means, it will be noted that the general arrangement of parts defines an annular, enclosed air chamber 72. This chamber is defined between the ring 32 and its seals 34 at the cone support, the band 36 and its seals 38, the base seal 48 and cone seal 54, and the flexible sealing strip 64.

Also forming a part of the dust and contaminant removal structure is an upright groove 74 in the base seal 48 which opens at its upper end through the angled surface 50 into the air chamber 72. With reference to FIGS. 5, 6, 7, 8 and 9, base seal 48 has an inlet 78 communicating with the air chamber 72 and connected to an inlet conduit 80. This base seal also has an outlet 82 communicating with groove 74 and spaced from the inlet and connected to an outlet conduit 84. Inlet 78 and outlet 82 are associated with a filter 86 and a blower 88 in a novel arrangement to be described. The filter and blower means may be suitably mounted on the crusher, such as on the outside of the crusher wall 24, or if desired these members may form a part of independent filtering and blowing mechanisms apart from the crusher. In the arrangement shown, the inlet conduit 80 is connected to a passageway 90 on an upstanding web 92 integral with the crusher, and the outlet conduit 84 is connected to a passageway 94 also on the web 92. Conduit 80 to the inlet 78 and the passageway 90 are in direct communication with the outlet 96 of the blower 88. Conduit 84 from the outlet 82 and the passageway 94 are in direct communication with the inlet 98 of the filter 86. The outlet 100 of the filter is connected directly to and comprises the inlet to the blower.

In this arrangement, blower 88 forces air into the inlet 78 and into the air chamber 72. Air is pulled out the outlet 82, then through the filter 86, and back into the blower. By this arrangement, the blower is always moving clean air and will not be subject to abrasion damage from dust or other contaminants.

A makeup air line 102 leads from a filter 104 to the inlet of the filter 86. The inlet to filter 104 is open to atmosphere, and the makeup air that passes therethrough and into the inlet of the blower makes for a slightly higher pressure in the outlet of the blower and air sealing chamber 72 than in the outlet 84 leading to the filter. This slightly higher pressure can be controlled by the size of the air line 102 or if desired by suitable valving.

In the operation of this embodiment of the crusher, and with reference to FIG. 2, the cone seal 54 as it gyrates exposes groove 74 around the base sealing ring 48 to the chamber 72. This exposure is widest at the outermost eccentric point of the stroke of the crushing head and tapers to shut off points equally away from this wide point. Such exposure continually moves through the full circumference of the groove 74 at the RPM at which the cone head is gyrated. Since the blower maintains the pressure in the air chamber 72 at a slightly higher degree than at the outlet, this pressure differential creates a continuous vacuum effect which sweeps around the groove 74. Blower 88 is preferably a high velocity regenerative blower that will move air flow normally above 160 fps and develop pressure vacuum of 40" $H_2O$.

Every grain of rock dust or other contaminant passing between the seals must cross groove 74 whereby it is instantly caught in the airstream. Should any dust succeed in crossing the groove, it must either settle instantly or go into air suspension and will be vacuumed out by the exiting air. Any metal particles that may rub off the sliding surfaces 50 and 52 will also be picked up in the airstream. Also magnetic cleanout plugs 104 may be provided in the base seal 48 to clean out any of such metal particles. Also, magnets may be employed with the filter to trap iron powder which might otherwise pass through the system.

The slightly higher air pressure within the air chamber preloads the seals to help hold a tighter contact.

In the embodiments of FIGS. 10–15, a base seal or ring 48' is employed having a somewhat modified form of structure and operation from that of FIG. 1, to be described. Otherwise, this seal is associated with structure similar to that shown in FIG. 1, namely, its engagement by a cone seal 54 which gyrates with the crusher cone 10, sealing ring 32 and its seals 34, and sealing band 36 and its seals 38. Although, as stated, the base seal 48' has somewhat different structure from that described in connection with the embodiment of FIG. 1 and its operation is somewhat different, it is similarly associated with an air chamber 72' which is sealed from the internal parts of the crusher the same as that described in connection with FIG. 1. As will be described, the base seal 48' is instrumental in intercepting dust moving along the spherical rubbing surfaces 50' and 52 of the base seal 48' and cone seal 54, respectively.

Figure 14:
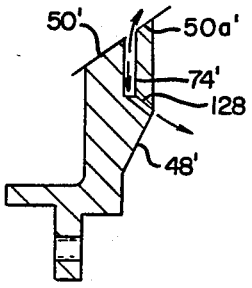
FIG. 14 is a sectional view of the base seal, taken on the line 14—14 of FIG. 13 but in upright relation.
Figure 15:
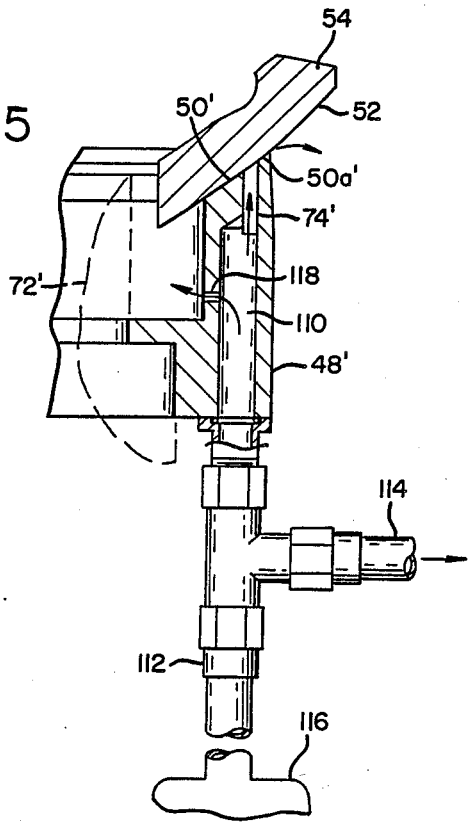
FIG. 15 is a sectional view taken on the line 15—15 of FIG. 13 also in upright relation.

Base seal 48 also employs an upright groove 74' which opens through the spherical surface 50'. As best seen in FIGS. 14 and 15, groove 74' is offset toward the outer defining surface of seal 48 whereby to provide only a narrow band of metal **50*a'*** between this groove and the said outer defining surface.

A pair of inlet ports 110 are provided 180 degrees apart at the underside of the seal 48'. One inlet port 110 has suitable connection to a pressured air supply 112 which includes a branch line 114 for feeding the other inlet port. Air supply 112 has suitable filter means 116 therein for supplying dust free air.

Figures 10, 11, 12:
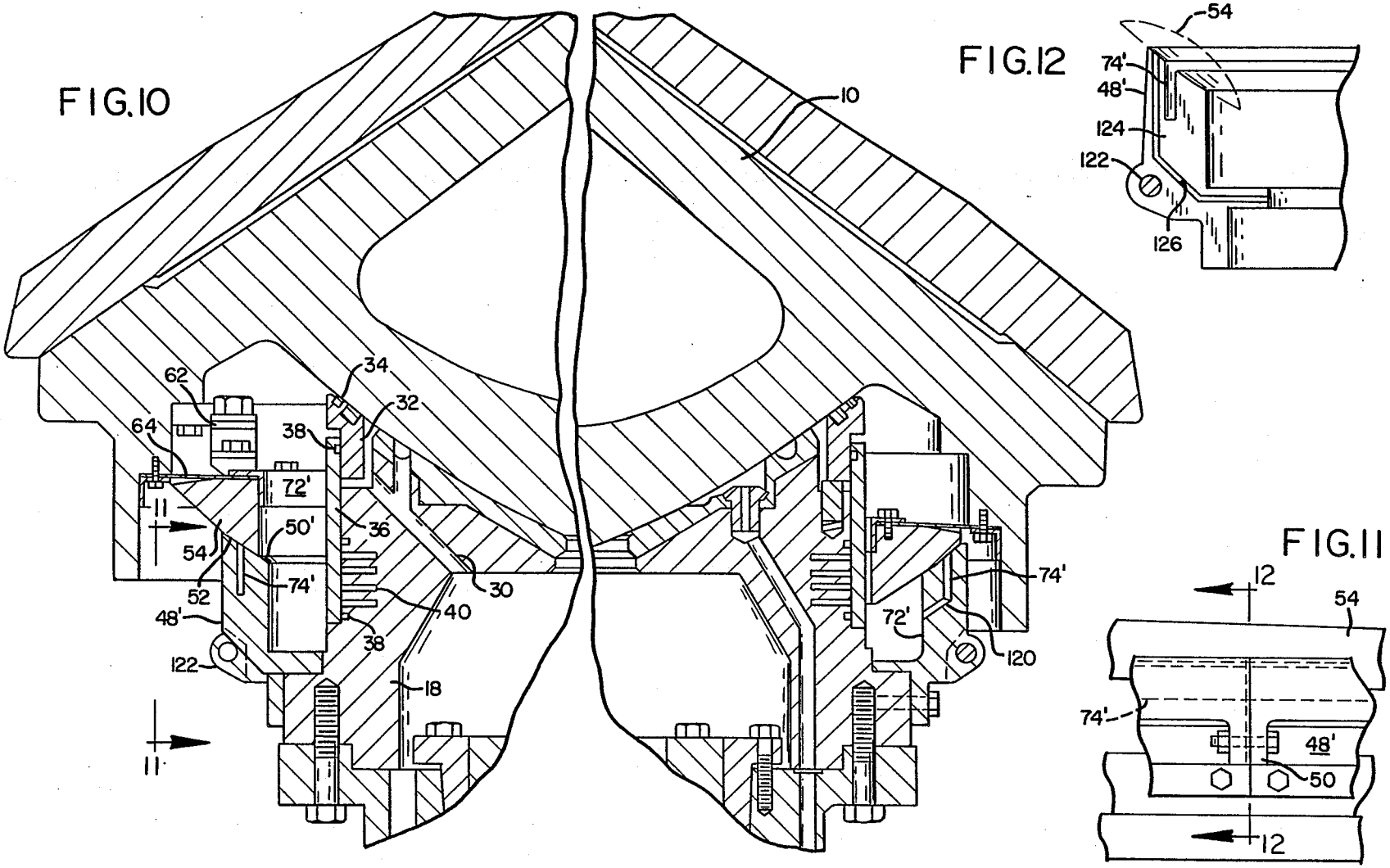
FIG. 10 is a foreshortened vertical central sectional view illustrating principles of a second embodiment of the invention.
FIG. 11 is a fragmentary elevational view taken on the line 11—11 of FIG. 10.
FIG. 12 is an elevational view of the end of a segmented base seal, this view being taken on the line 12—12 of FIG. 11.
Figure 13:
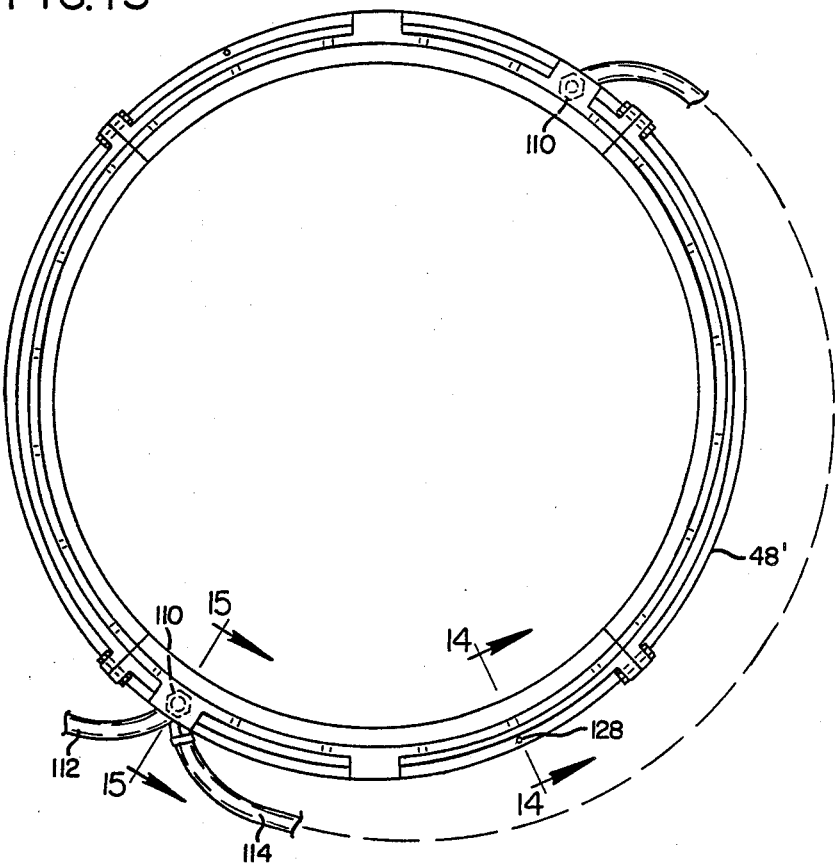
FIG. 13 is a bottom plan view of the base seal of FIG. 10.

Inlet ports 110 communicate directly with the groove 74' and also communicate with air chamber 72' by means of small ports 118, FIG. 15, extending between this inlet and the air chamber, and also by small ports 120, FIG. 10, extending between the groove 74' and the air chamber. Ports 118 and 120 are of sufficient size and number to provide an equalization of pressure between air chamber 72' and groove 74'.

In the embodiment of FIG. 10, the offset position of the upright groove 74' in the base seal is such that regardless of the gyrated position of the cone seal 54, the latter always covers this groove. In this embodiment, positive pressure is applied through supply 112 to the groove 74'. Such air under pressure tends to float the cone seal 54 to reduce friction and wear and exhausts outward across the narrow band **50*a'* of metal. This tends to blow dust away from the sliding surfaces before it can penetrate metal porosity. The small holes 118 and 120 provide communication between the grooves 74' and the air chamber 72'** to balance the air pressure so that air will not flow inward between the two seals.

In a preferred structure, the base seal 48' is formed in segments to permit its removal for cleaning or replacement without dismantling parts of the crusher above it. For this purpose, and with particular reference to FIGS. 11, 12 and 13, these segments are formed with depending ears 122 for bolting together. For the purpose of providing an air seal between these segments, one of the facing surfaces 124 in each joint is provided with an inset O-ring seal 126. Groove 74' has one or more small ports 128, FIG. 14, leading from the lower end thereof to atmosphere. These ports are of a very small size and of a number to provide for flushing of any dust that may escape into the groove but at the same time they allow only minimum leakage so as not to materially reduce the air pressure in the groove.

In each of the embodiments, an inner chamber is provided which is sealed off to the inner working parts of the crusher and this air chamber together with groove means in the base seal cooperate to intercept dust which may move along spherical surfaces of the rubbing seals, and to move such dust away from inner portions of the crusher.

It is to be understood that the forms of our invention herein shown and described are to be taken as preferred examples of the same and that various changes in the shape, size and arrangement of parts may be resorted to without departing from the spirit of our invention, or the scope of the subjoined claims.

Having thus described our invention, we claim:

1. A gyratory rock crusher comprising:
a base frame,
a crusher cone,
inner drive and support means on said frame moving said cone in a gyratory movement,
cooperating spherical surfaces on said base frame and cone supporting said cone in said gyratory movement,
a first annular seal member on said base frame,
a second annular seal member on said crusher cone,
said first and second seal members having cooperating spherical surfaces with slidable rubbing surface engagement with each other in the gyratory movements of said cone,
annular groove means in one of said seal members opening through said spherical rubbing surface thereof,
and air moving means communicating with said annular groove means directing air currents through said groove means to intercept dust moving along said spherical surfaces and to move such dust away from inner portions of said crusher.

2. The gyratory rock crusher of claim 1 wherein said air moving means applies elevated pressure to said groove means and exhausts it to the exterior in a path between said rubbing surfaces for intercepting dust and preventing inward travel thereof along said rubbing surfaces.

3. The gyratory rock crusher of claim 1 including an air chamber between said seal members and the inner drive and support means, and inner seal means sealing off said air chamber from said inner drive and support means.

4. The gyratory rock crusher of claim 1 wherein said air moving means directs elevated pressure into said annular groove means, and ports in the one seal member which has the said groove means therein for establishing communication between said groove and said air chamber to balance the air pressure therein.

5. The gyratory rock crusher of claim 1 including reduced diameter exhaust ports extending from said groove means to the exterior of the crusher for flushing inwardly escaped dust from said groove means.

6. The gyratory rock crusher of claim 1 including filter means in said air moving means for supplying dust-free air.

7. The gyratory rock crusher of claim 1 wherein said seal members have inwardly and outwardly defining wall surfaces and said annular groove means is provided in said second seal member, said annular groove means opening through the spherical surface of said second seal member in offset relation closer to the outwardly defining wall surface of said second seal member than to its inwardly defining wall surface.

8. A gyratory rock crusher comprising:
a base frame,
a crusher cone,
inner drive and support means on said frame moving said cone in a gyratory movement, cooperating spherical surfaces on said base frame and cone supporting said cone in said gyratory movement, a first annular seal member on said base frame, a second annular seal member on said crusher cone, said first and second seal members having cooperating spherical surfaces with slidable rubbing surface engagement with each other in the gyratory movements of said cone, and an air sealing chamber formed between said two seals and said inner drive and support means.

9. A gyratory rock crusher comprising:

a base frame, a crusher cone, inner drive and support means on said frame moving said cone in a gyratory movement, cooperating spherical surfaces on said base frame and cone supporting said cone in said gyratory movement, a first annular seal member on said base frame, a second annular seal member on said crusher cone, said first and second seal members having cooperating spherical surfaces which have slidable rubbing surface engagement with each other in the gyratory movements of said cone, an air sealing chamber between said seal members and the inner drive and support means, annular groove means in one of said seal members opening through said spherical rubbing surface thereof, and air circulating means supplying air to said air sealing chamber and drawing off air from said groove means.

10. The gyratory rock crusher of claim 9 including filter means in said air circulating means for cleansing air being withdrawn from said air sealing chamber.

11. The gyratory rock crusher of claim 9 wherein said air circulating means in returning air to said air sealing chamber maintains the pressure in said air sealing chamber at a higher pressure than the pressure of air being withdrawn from said annular groove means.

12. The gyratory rock crusher of claim 9 wherein said air circulating means includes air passageway means leading from the lower portion of said annular groove means, a filter having an inlet and an outlet, said inlet being connected to said air passageway means, a blower having an inlet and an outlet, said blower inlet being connected to the outlet of said filter, and air passageway means connected between the outlet of said filter and said air sealing chamber.

13. The gyratory rock crusher of claim 9 wherein said air circulating means includes air passageway means leading from the lower portion of said annular groove means, a filter having an inlet and an outlet, said inlet being connected to said air passageway means, a blower having an inlet and an outlet, said blower inlet being connected to the outlet of said filter, and air passageway means connected between the outlet of said filter and said air sealing chamber, and air makeup inlet means between the outlet of said filter and the inlet of said blower maintaining the pressure in said air sealing chamber at a higher pressure than the pressure of air being withdrawn from said annular groove means.

14. The gyratory rock crusher of claim 13 wherein said air makeup inlet means includes a filter and controlled flow means.

* * * * *